US006457683B1

(12) United States Patent
Armstrong, Sr.

(10) Patent No.: US 6,457,683 B1
(45) Date of Patent: Oct. 1, 2002

(54) PORTABLE SHELTER LANTERN AND HEATER STAND

(76) Inventor: Dennis W. Armstrong, Sr., 2846 E. Booth Rd., Au Gres, MI (US) 48703

( * ) Notice: Subject to any disclaimer, the term of this patent is extended or adjusted under 35 U.S.C. 154(b) by 0 days.

(21) Appl. No.: 09/956,572

(22) Filed: Sep. 19, 2001

(51) Int. Cl.[7] ..... A47F 5/00

(52) U.S. Cl. ..... 248/122.1; 248/132; 248/157; 248/125.1

(58) Field of Search ..... 248/122.1, 124.1, 248/124.2, 125.1, 125.8, 132, 149, 161, 157, 273, 121; 362/431, 432

(56) References Cited

U.S. PATENT DOCUMENTS 1,154,904 A * 9/1915 Bain ..... 248/121
1,452,640 A * 4/1923 Hulick ..... 248/121
3,995,796 A * 12/1976 Kline ..... 248/121
4,065,085 A * 12/1977 Gellatly ..... 248/124
D337,849 S * 7/1993 Bradley ..... D26/138
5,307,789 A * 5/1994 Newby ..... 126/9 R
5,385,280 A * 1/1995 Littlepage et al. ..... 248/124 X
5,860,410 A 1/1999 Hollingsworth, Jr. ..... 126/40

* cited by examiner

*Primary Examiner*—Ramon O. Ramirez

(57) ABSTRACT

A light weight, knockdown, portable lantern and heater stand for use in a collapsible, foldable, portable shelter is described. The support structure of the stand is made from hollow tubular material. An arched shaped planar base is attached to a support pole extending vertically upwards to a right-angled bend continuing with a horizontal support section which terminates with a beam clamp. The beam clamp attaches to the roof beam of the portable shelter. A disassembly means is located near the middle of the vertical support. A vertical adjustment means is slidably located in the vertical support, and a horizontal adjustment means is slidably located in the horizontal support. A heater support bracket is attached to the vertical support and a lantern support loop is attached to the horizontal support. A double ended article hook and a heater safety chain is attached to the vertical support. The assembled stand will support a lantern and a heater plus additional items above the floor. The disassembled stand will lie inside a collapsed and folded portable shelter for storage and transportation.

13 Claims, 10 Drawing Sheets

PORTABLE SHELTER LANTERN AND HEATER STAND

CROSS-REFERENCE TO RELATED APPLICATIONS

Not applicable.

BACKGROUND

1. Field of the Invention

The present invention relates to portable stand assemblies, specifically to a portable stand assembly useful for supporting a lantern and a heater in a collapsible, foldable, portable shelter.

BACKGROUND

2. Description of Prior Art

Embodiments of the present invention are applicable to a collapsible, foldable, portable shelter, hereinafter referred to as a portable shelter, of a type which utilizes a longitudinal, tubular roof beam. Portable shelters are used by individuals involved in a wide variety of outdoor activities that may require mobility, concealment, or protection from the elements. They are easily transported and assembled, and they make the outdoor experience more enjoyable. For example hunters, campers, photographers, bird-watchers, astronomers, and other naturalists can benefit from the use of portable shelters. Embodiments of the present invention also have industrial applications. For example at construction sites, by maintenance and utility crews, and in farming situations in which a temporary portable shelter, supplied with heat and illumination, is desired.

Characteristics, associated with portable shelters, make them increasingly popular with persons who engage in ice-fishing activities. Embodiments of the present invention have particular application to ice-fishing activities which are conducted in cold weather and, usually, into late evening or nighttime hours requiring a heat and light source. Unlike noncollapsible ice-fishing houses, portable shelters are easily transported to any lake or river one wishes to fish, and they are easily moved to various fishing spots during an outing. When the ice-fishing season ends, the portable shelter can be stored in an attic, garage, closet, etc., until the next season and not require any yard space.

Portable shelters typically utilize collapsible, folding, tubular end-wall frames which support a centrally located, longitudinal, tubular roof beam. This framework assembly is used to support a fabric covering. A hinged floor seam is located crosswise at midlength, such that when the portable shelter is collapsed, and the floor is folded back upon itself, the original length of the floor is halved. The outer fabric covering and collapsed framework are sandwiched and stored between the two halves of the floor. Various brands of portable shelters are readily available in various sizes which have a range of approximately 41 cm in their width measurements (106 cm to 147 cm), and a range of approximately 51 cm in their height measurements (147 cm to 198 cm). The overall length varies from approximately 1.5 m to 2.4 m. The collapsed, folded height of portable shelters, when ready for transport, varies from approximately 13 cm to 25 cm. The Shappell Corp. and the Clam Corp., for example, manufacture a variety of portable shelters in various sizes. Also, Cabela's, Inc. and Bass Pro Shops, Inc. retail a full line of portable shelters. Equipment, to generate heat and to provide illumination, is usually required in addition to shelter.

Readily available, liquid or propane fueled lanterns and heaters, have long been the standard in the art to perform these functions. For example, the Mr. Heater Corp. manufactures a single burner, "sun flower"-type heater, constructed with a small diameter rod frame, which is particularly popular for ice fishing due to its light weight and versatility; it can also be used as a stove to cook food. In addition, the Coleman Co., Inc. manufactures a number of products for outdoor use, including a variety of portable lanterns, which are particularly popular for ice fishing due to their proven dependability and light weight.

Mobility of the equipment must be a major consideration. Locating schools of fish may involve packing up the equipment and moving to different locations, possibly several times during a single outing. Additionally, ice fishing is a sport which can easily end up being conducted in a very harsh environment. Conditions can suddenly arise requiring expeditious transportation of the equipment, including the portable shelter and heat and light sources, to a safer location. Sudden changes in wind direction, blizzards, whiteouts, drifting ice, and unexpected, opened cracks in the ice which must be crossed, are examples of such conditions which, in some cases, can become life threatening. Therefore, whether on foot or using mechanized equipment such as a snowmobile or an all terrain vehicle (ATV), equipment mobility is a concern of the utmost importance. Mobility can be increased by the use of a portable shelter. The use of a lantern and a heater, particularly those with integral fuel tanks, also increases mobility: only the amount of fuel necessary for the ice-fishing outing needs to be transported.

Organization of the equipment is necessary for a safe and enjoyable outing. However, the achievement of compactness and minimum weight in portable shelters has resulted in a minimum of floor space. In the case of ice fishing in particular, this situation is further exacerbated by the requirement of a variety of fishing equipment including tackle, seats of some type, heavy clothing, and bulky, insulated boots. Most of these items require space inside of the portable shelter along with the heat and light sources. Wind, forcing the fabric sides of the portable shelter inwards, especially on the side above the fishing holes, driving the participants towards the rear wall of the portable shelter, decreases interior storage space. Because the portable shelter has a flexible fabric outer shell, there are no shelves or other similar storage devices available. Equipment items, such as ice scoops, gaff hooks, binoculars, and cameras, for example, should be stored readily available, off the floor, to eliminate damage and for safety reasons. A heater is frequently placed on the floor of the portable shelter where, due to the close quarters, it can easily cause a burn to an occupant's body or clothing. Also, fishing lines can be burnt through, resulting in lost terminal tackle and, occasionally, a fish. A lantern may also be placed on the floor, where the light can shine in the occupants' eyes causing irritation, and making it difficult to see down the fishing holes. The lantern may also be suspended from the roof beam, but since the roof beam is centrally located, the lantern will be very close to the occupants' heads, presenting a dangerous situation. In order to use the illumination from the lantern as a fish attractant, the lantern should be suspended above the fishing holes. Because heaters and lanterns usually operate on flammable fuel, they should be safely and securely mounted in appropriate locations off the floor where they will not be knocked over or damaged. The very limited space inside a portable shelter makes the organization of equipment difficult.

To solve these problems, a light weight, knockdown, sturdy, and easily transportable, lantern and heater stand, for use in a portable shelter, is needed. The stand should require a minimal amount of floor space, thus increasing the usable floor space. The stand should be easy to assemble for use, and it should be easy to disassemble when not in use. The stand should securely hold a lantern in a safe position relative to the seated occupants and provide overhead illumination. The stand should safely and securely support a heater in a suitable location off the portable shelter floor. The stand should be easily adjustable to accommodate the various sizes of portable shelters: a person would not have to purchase another stand if he/she purchased a portable shelter of a different size. The stand should provide storage off the portable shelter's floor for additional items, such that they will be safely stored and readily available. The stand should provide additional support to the roof fabric of the portable shelter to protect against snow loads. The stand should stabilize the portable shelter against wind forces, especially on the side where the fishing holes (if they are present) are located. The disassembled stand should be capable of being placed inside a collapsed, folded, portable shelter for storage, transportation, and immediate availability for reassembly. The stand should be able to be built from readily available, inexpensive materials.

One possible approach to address at least some of these problems is disclosed in U.S. Pat. No. 5,860,410 to Hollingsworth, Jr. (1999). This patent discloses a stand, preferably of unitary construction, which supports a heating device, and an upstanding section which supports a lighting device, and directs fuel to these devices from a single source. A fuel line directs fuel to the heating and lighting device from a single fuel source, minimizing the need for filling separate heating and lighting devices on a regular basis. The stand has a base frame of polygonal shape as viewed from above, minimizing the chances of tipping over. The stand is described as allowing close mounting against a wall or other structure, such as the wall of an ice-fishing house.

The apparatus, described in Hollingsworth, Jr., was designed to be used in an ice-fishing house: a building that is used for the particular purpose of ice fishing. The patent addresses the placement of a lighting and a heating device in a single unitary stand and a provision for a single fuel source for both. This particular stand and fuel arrangement may be useable in an ice-fishing house. However, where mobility is a major issue, such as during an ice-fishing outing conducted with a portable shelter, the stand would have a number of serious disadvantages:

(a) The stand, which is described as "portable," and "enabling easy transport in a pick up truck bed or the cargo area of a van or similar vehicle," cannot reasonably be disassembled, nor stored inside a collapsed, folded, portable shelter for increased mobility and be ready for prompt reuse.

(b) The base of the apparatus would rest on the portable shelter floor further exacerbating the minimal floor space situation. In the case of ice fishing, the stand would have to sit on the floor between the fishing holes where it would hinder fishing operations.

(c) Because the heater and lighting device utilize the same fuel supply tank, and since an object for this design is to minimize the need for frequent refueling of separate devices, it stands to reason that a relatively large fuel tank is prescribed. FIG. 5 of the patent to Hollingsworth, Jr. shows a fuel source indicated to be a propane tank. It appears to be what is commonly known in the art as a "twenty pounder": twenty pounds of propane plus the weight of the steel tank. A larger fuel supply than necessary for the anticipated fishing trip translates into excess weight and decreased mobility.

(d) If the single fuel supply runs out, leaks out, or for some other reason, becomes inoperative, both the heat and light source are inoperative. Persons, knowledgeable in the art, realize that the utilization of a white gasoline operated lantern, equipped with an integral fuel tank, is especially advantageous. Since a lantern produces both heat and light, and in the event that the heater should become inoperative, one would still continue to have a heat source. Additionally, if the lantern runs out of fuel, and you have a snowmobile or other ATV available, the gasoline from the snowmobile or ATV can be used, in an emergency, to fuel the lantern.

While there are other lantern stands, and heater stands, and combination lantern and heater stands described in the prior art, there are no such stands, that the applicant is aware of, that have been specially adapted for use in collapsible, foldable, portable shelters. Nothing in the prior art provides the benefits attendant with the present invention. Additionally, the prior patents do not suggest the present inventive combination of component elements arranged and configured as disclosed and claimed herein. The present invention achieves its intended purposes, objects, and advantages through a new, useful, and unobvious combination of elements, with the use of a minimum number of functioning parts, at a reasonable cost to manufacture, and by employing readily available materials. Even though certain embodiments of the invention particularly apply to ice fishing, and to portable shelters which utilize a longitudinal tubular roof beam, the invention is by no means limited to these embodiments. Portable shelters utilizing a longitudinal, tubular roof beam are the most commonly manufactured and used type of portable shelter. However, the design of the invention can easily be altered to accommodate any portable shelter regardless of its shape or framework configuration.

SUMMARY

In accordance with one embodiment of the present invention, a portable stand assembly comprises a base connected to an inverted L-shaped support terminating with a beam clamp; a disassembly means is located in the vertical support, and a lantern support loop is attached to the horizontal support.

Objects and Advantages

Accordingly, some of the objects and advantages of the present invention are:

(a) to provide a light weight, sturdy, and easily transportable, lantern and heater stand for use in a portable shelter;

(b) to provide a lantern and heater stand for use in a portable shelter that requires minimal floor space;

(c) to provide a lantern and heater stand for use in a portable shelter that may be easily assembled for use;

(d) to provide a lantern and heater stand for use in a portable shelter that may be easily disassembled when not in use;

(e) to provide a stand for use in a portable shelter to allow a lantern to be securely supported in a portable shelter for the best visibility and safety for the occupants;

(f) to provide a portable stand for use in a portable shelter that safely and securely supports a heater off the floor;

(g) to provide a lantern and heater stand for use in a portable shelter that is adjustable in height to fit in most portable shelters;

(h) to provide a lantern and heater stand for use in a portable shelter that is adjustable in width to fit in most portable shelters;

(i) to provide a lantern and heater stand for use in a portable shelter that can store additional equipment items off the floor;

(j) to provide a lantern and heater stand for use in a portable shelter that can stabilize the portable shelter against snow loads;

(k) to provide a lantern and heater stand for use in a portable shelter that can stabilize the portable shelter against wind forces;

(l) to provide a lantern and heater stand for use in a portable shelter that can be stored inside a collapsed, folded, portable shelter for storage, transportation and immediate availability for reassembly;

(m) to provide a lantern and heater stand for use in a portable shelter that can be made inexpensively from readily available materials.

Other objectives and advantages of the invention will be readily apparent to those skilled in the art once the invention has been described.

BRIEF DESCRIPTION OF THE DRAWINGS

In the drawings, closely related figures have the same number but different alphabetical suffixes.

REFERENCE NUMERALS IN DRAWINGS

Figure 1:
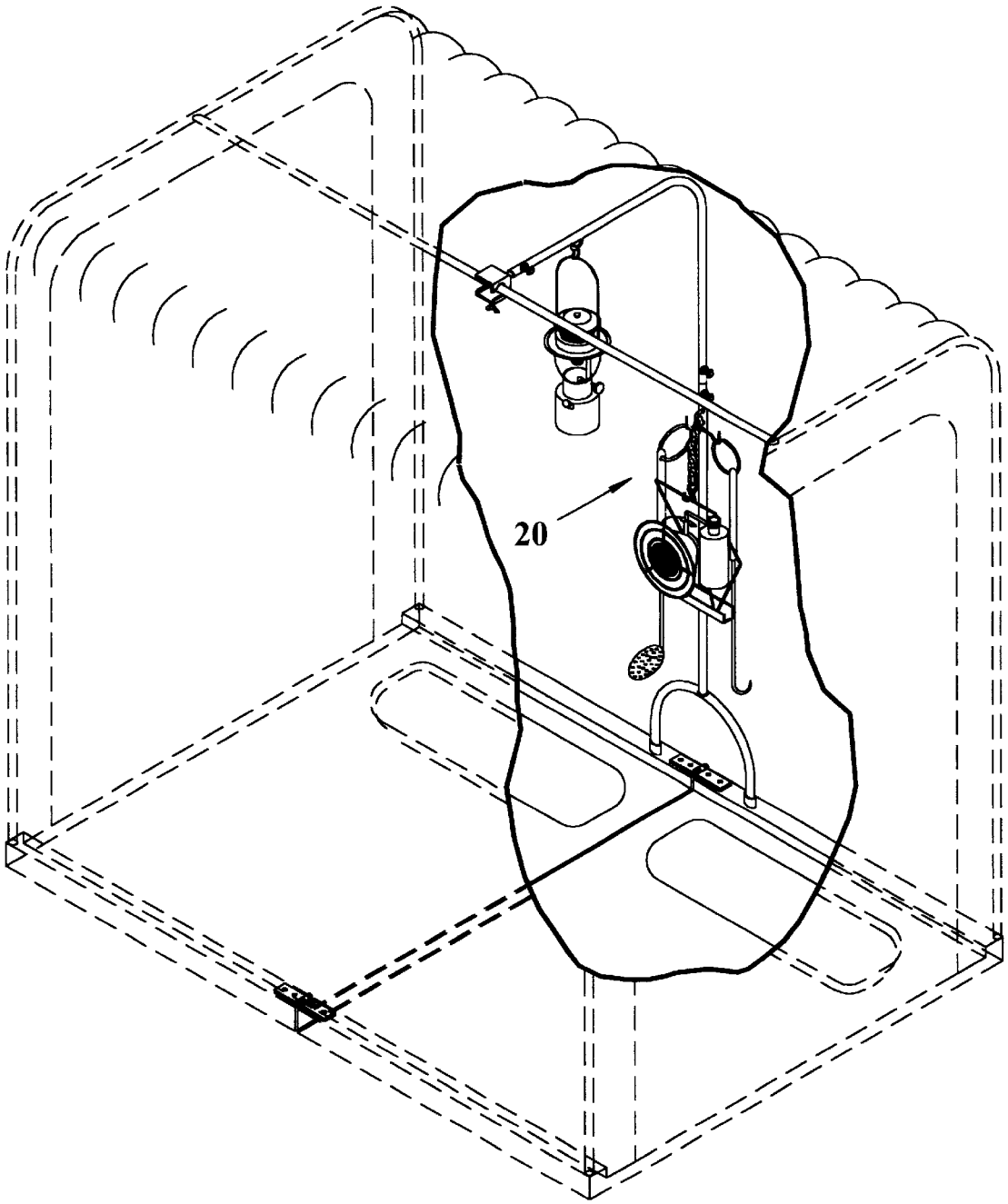
FIG. 1 is an isometric view showing, within a portable shelter (with outer fabric cut away for clarity), a stand attached to the portable shelter's horizontal roof beam.

20 support stand 22 base
24 base leg end 24' base leg end
26 leg cap 26' leg cap
28 base arch midpoint 30 support
32 lower end of support 30 34 base weld
36 upper end of support 30 38 socket
40 stop pin 42 socket nut
44 hand bolt 46 solid vertical adjustment bar
48 upper support 50 lower end of upper support 48
52 vertical adjustment nut 54 vertical adjustment bolt
56 ninety (90) degree bend 58 distal end of horizontal support 48
60 solid horizontal adjustment bar 62 horizontal adjustment nut
64 horizontal adjustment bolt 66 beam clamp
68 distal end of bar 60 70 beam clamp weld
72 beam clamp lock nut 74 beam clamp lock bolt
76 beam clamp wing nut 78 beam clamp pressure surface
80 beam clamp cutout 82 heater bracket
84 heater bracket weld 86 chain attachment loop
88 upper end of safety chain 90 safety chain
92 safety hook 94 lower end of safety chain
96 double hook hanger bar 98 hanger bar weld
100 lantern hanger loop 102 heater shelf
104 shelf slot 106 shelf curb
108 shelf support 110 shelf support bracket
112 one of two hinges 112' other one of two hinges
114 flat stock 116 flat stock weld
118 hinge washer 120 horizontal end portion
122 shelf bracket weld

DESCRIPTION OF THE PREFERRED EMBODIMENT

This invention will be better understood and objects other than those set forth above will become apparent when consideration is given to the following detailed description thereof. With reference to the drawings and in particular to FIGS. 1 to 11D thereof, a new support stand, designed for use in portable shelters embodying the principles and concepts of the present invention and generally designated by the numeral 20 will be described. In the preferred embodiment, the main support body of the stand is constructed from hollow, cylindrical, tubular, metal material. However, the stand could be made from other materials such as square or rectangular, hollow, metal tubing, wood, polyvinylchloride (PVC), or fiber glass, for example, using suitable means for attaching brackets, fasteners, etc. Solid bar stock is indicated for use in two adjustment means. Various other types of material will be suggested for additional parts when they are described. Welded construction, where applicable, is preferred for strength and vibrational resistance. Easy disassembly into an upper and a lower section will be described below.

Figure 2:
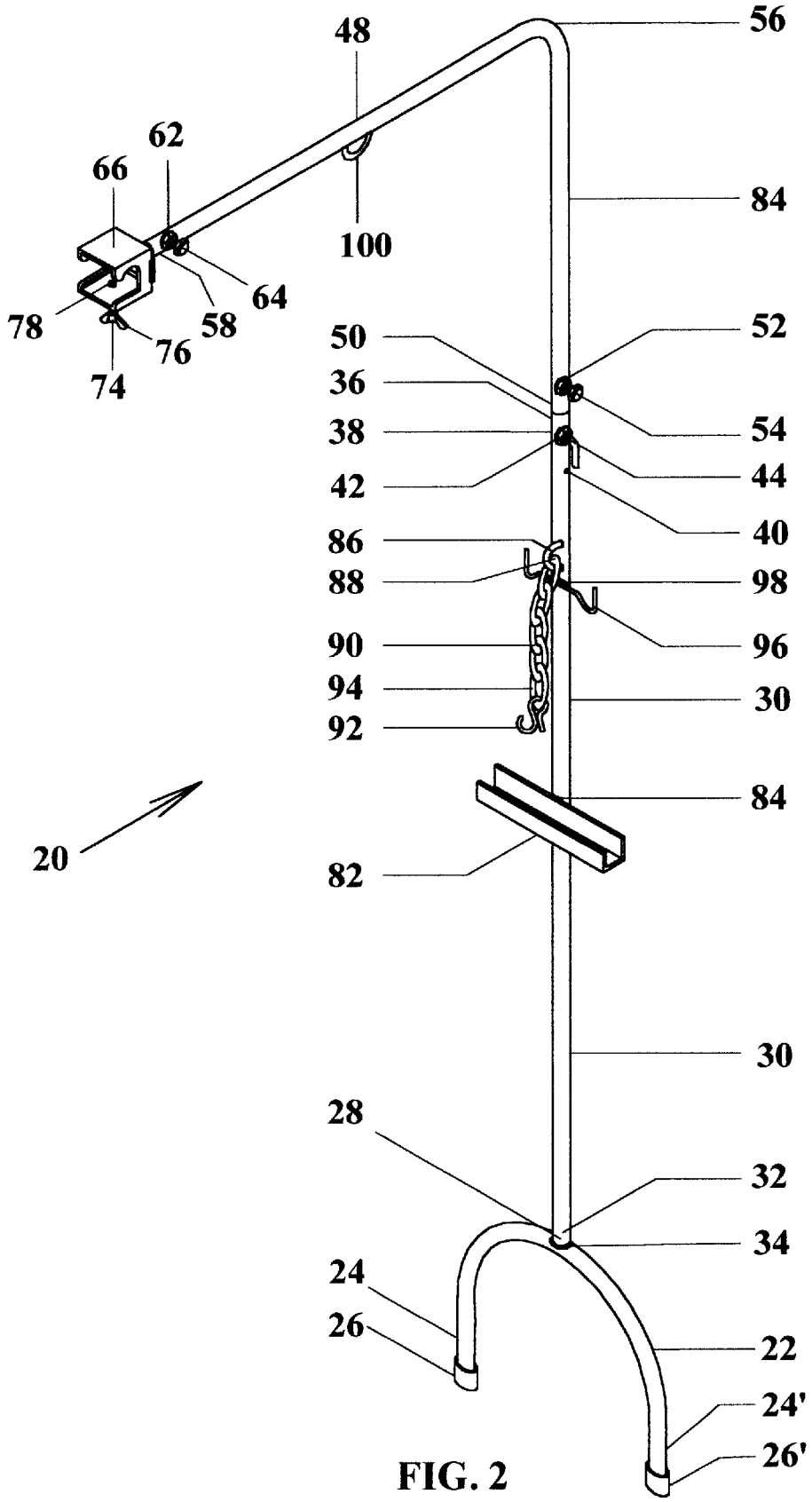
FIG. 2 is an isometric view of a stand with retracted vertical and horizontal adjusting means.
Figure 9:
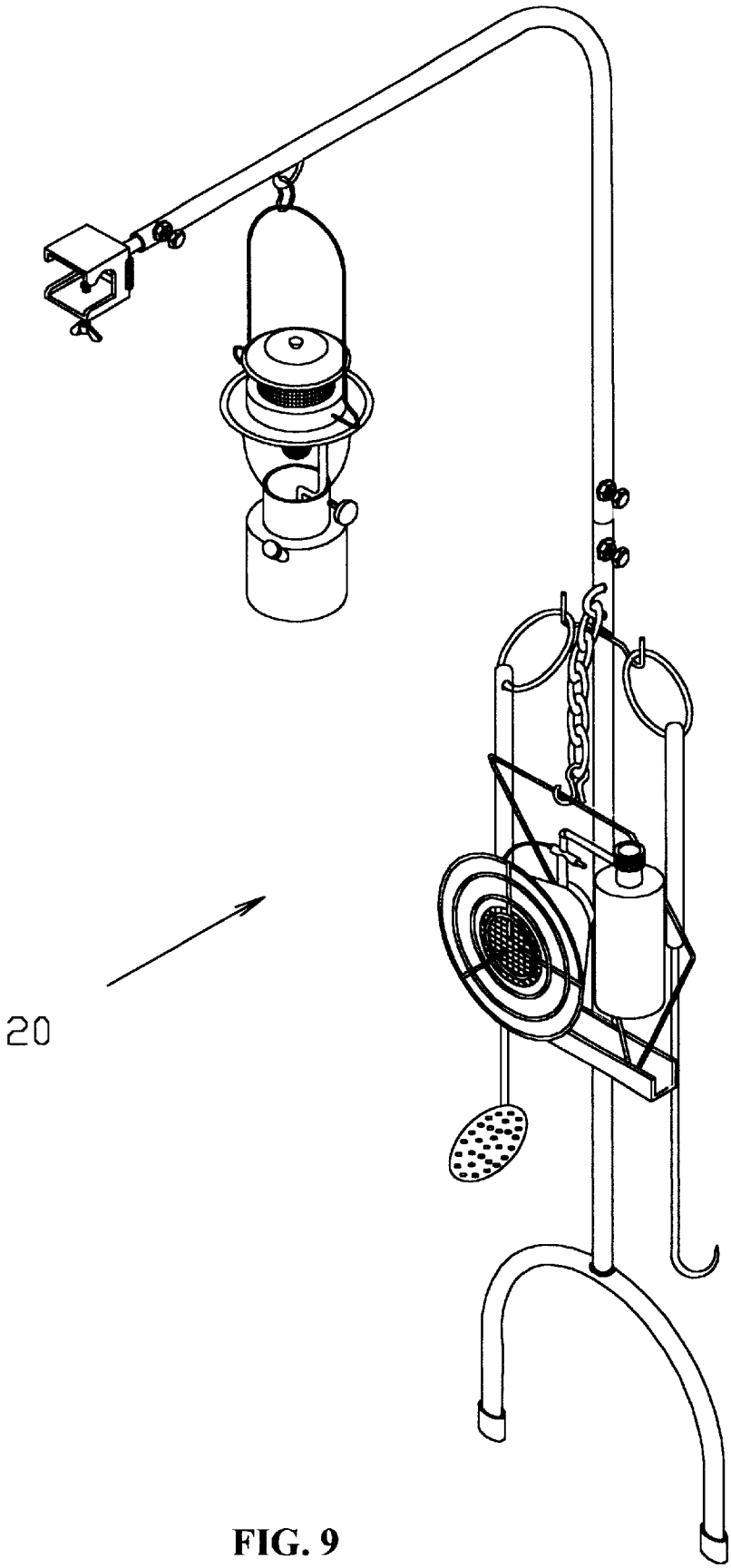
FIG. 9 is an isometric view of a stand supporting a lantern, heater, and additional articles.

From an overview stand point, a support stand 20 is designed to support a lantern and a heater, as well as organize additional articles of equipment, in a portable shelter as shown in FIG. 1 (with outer fabric cut away for clarity). FIG. 9 shows a larger overall view of stand 20 as it would appear removed from the portable shelter shown in FIG. 1. FIG. 2 shows the overall construction of stand 20.

Figure 8:
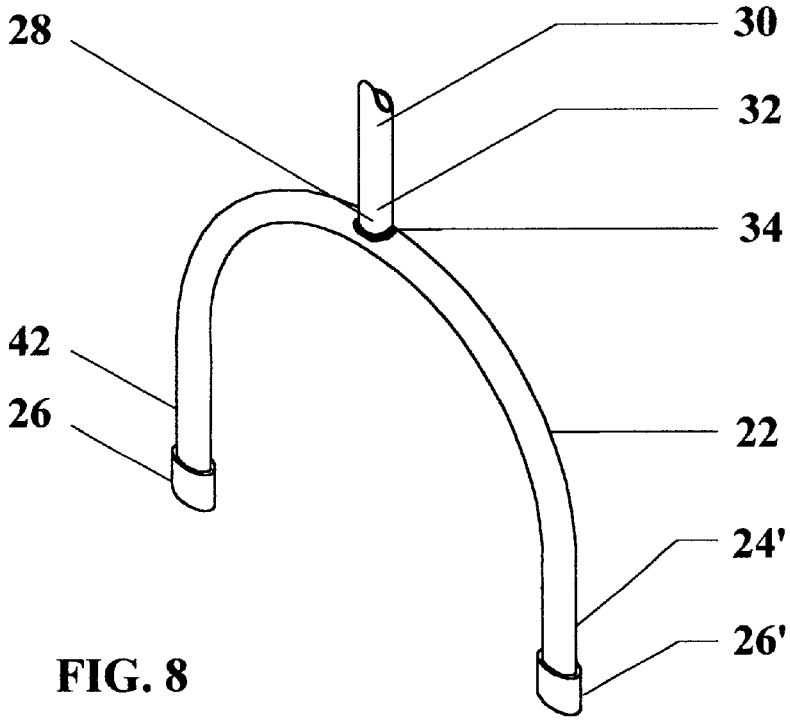
FIG. 8 is an isometric view showing the base section of a stand.

Referring to FIG. 8, according to the preferred embodiment of the invention, stand 20 includes an arched, or inverted-U shaped, planar base 22. A base leg end 24 and a base leg end 24' of base 22 is encased in a leg cap 26 and a leg cap 26', respectively. Caps 26 and 26' may be made of a plastic, nylon, or similar type material. Referring to FIG. 1, base 22 is preferably made in an arched or inverted-U shape for its vertical support strength, its minimum floor area requirement, and its ability to straddle a hinged seam in the portable shelter floor. If the floor is not lying flat due to uneven terrain, the hinged seam can rise up between, or fall below, the leg ends 24 and 24'; base 22 will continue to make two points of contact with the framework. An inverted T-shaped planar base would teeter on the raised seam. A planar type base is preferred because it takes up minimal floor space.

Referring to FIG. 2, extending vertically upwards from, and axially centered over a base arch midpoint 28 of base 22, is a spar, pole, or support 30. A lower end 32 of support 30 is filed or machined to give it a concave curvature so that it can mate with the convex curvature of the top of base 22. End 32 is welded around its circumference connecting it to base 22 by means of a base weld 34.

Figure 3A:
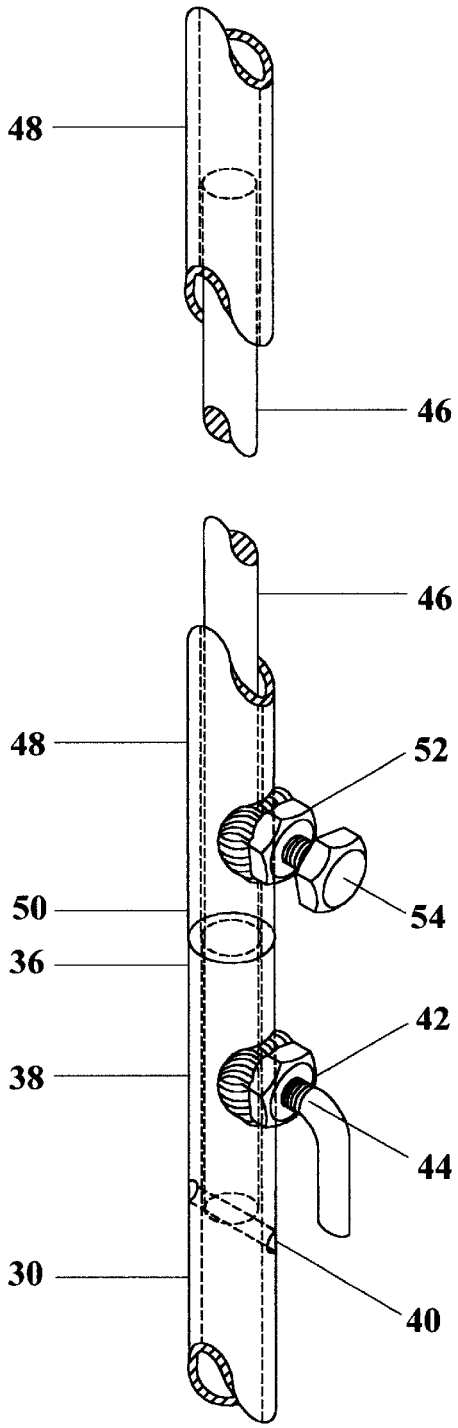
FIGS. 3A and 3B are isometric sectional views of the retracted and extended vertical adjustment mechanism of a stand, respectively.
Figure 3B:
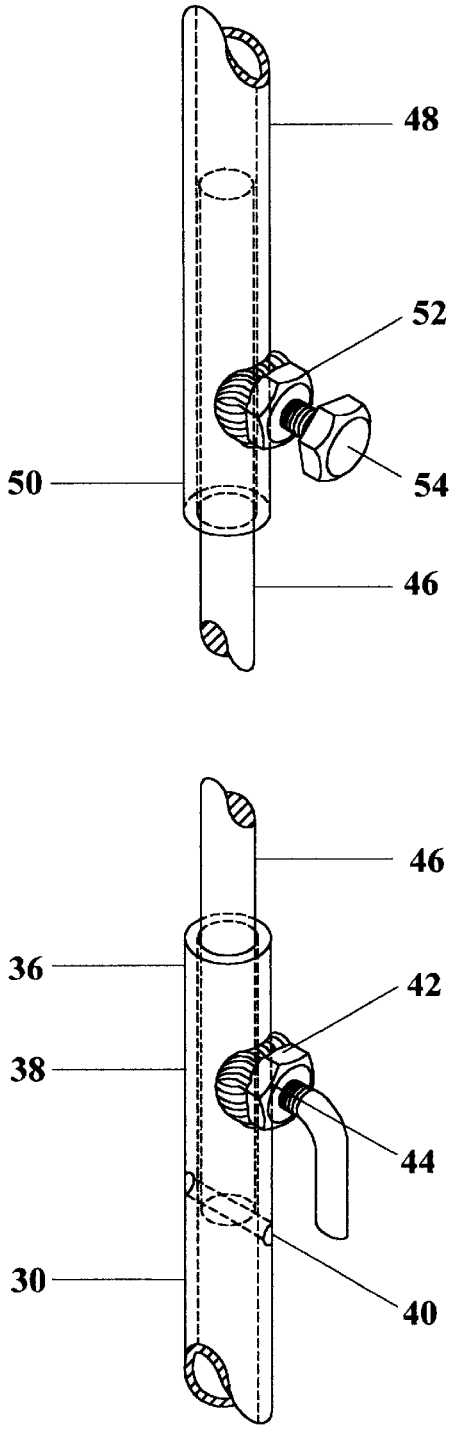

Referring to the lower half of FIG. 3B, a portion of support 30, beginning from an upper end 36 of support 30 continuing downwards approximately 8 cm toward the base 22, constitutes a receptacle, or a socket 38. Socket 38 is constructed by drilling a horizontal, diametrically oriented, through hole perpendicular to support 30. The hole can be located at any point on the circumference of support 30, approximately 8 cm down from the upper end 36 of support 30. A metal peg, roll pin, or a stop pin 40, the length of which is equal to the outside diameter of support 30, is inserted into the hole in the tubing wall on one side of support 30 and forced in until it passes coaxially into the diametrically opposed hole in the opposite wall. Both of the exposed ends of pin 40 are welded to the exterior of support 30 so it cannot come out or get lost. The location of the bottom and the depth of socket 38 are established by stop pin 40. The hollow, cylindrical, tubing of support 30, vertically upwards above pin 40, creates the sides of socket 38. At midheight of socket 38, approximately 4 cm down from the upper end 36 of support 30, a hole is drilled through one side, the diameter of which is slightly larger than the nominal size of a threaded socket nut 42. Nut 42 is welded coaxially over the pre-drilled hole such that it will allow a hand bolt 44 to be threaded into nut 42 and to pass through the side and into the interior of socket 38. Hand bolt 44 is formed into an L -shape by bending the non-threaded portion of a bolt of the same nominal size as nut 42. Generally, the longitudinal axis of the threaded portion of bolt 44 is perpendicular to support 30 and coplanar with base Referring to FIGS. 6 and 10, to facilitate storage of a disassembled stand inside of a folded, portable shelter, it is preferable to affix all similar welded nut and bolt combinations of stand 20, such as nut 42 and bolt 44, described above:

(a) coaxially over a pre-drilled hole, such that the longitudinal axis of the bolt, when threaded into the nut, will be parallel to, or coplanar with, the plane of base 22;

(b) perpendicular to the longitudinal axis of the support member to which it is attached;

(c) horizontally oriented when the stand is assembled for use.

Figure 10:
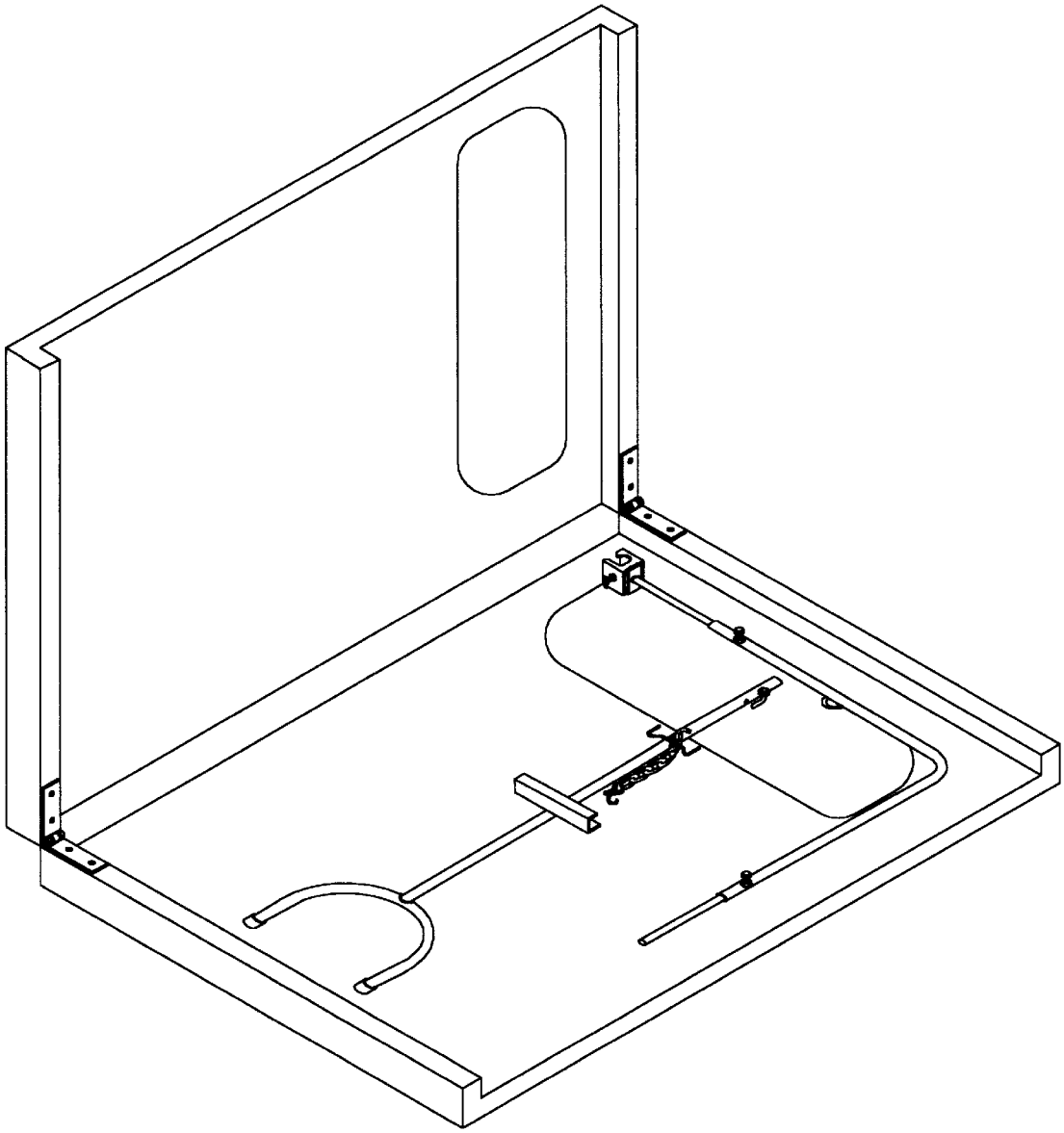
FIG. 10 is an isometric view of a disassembled stand stored within the floor portion of a collapsed and partially folded portable shelter (with outer fabric and interior framework removed for clarity).

The decision as to which side of a support to attach the welded nut and bolt combination is one of handedness: either side of the stand can be used. Additionally, the lower section of stand 20, including base 22 and vertical support 30, should have an overall height approximately equal to, but not greater than, 1.3 m. This dimension will allow the lower section of stand 20 to be stored and transported inside most folded, portable shelters. As will be described in detail later, this dimension allows an upper support 48 section of stand 20 to be adjusted vertically and horizontally to fit most portable shelters, and, in its adjusted state or condition, the upper support 48 section will also be of a size which will allow it to be stored inside a folded, portable shelter as shown in FIG. 10.

Figure 6:
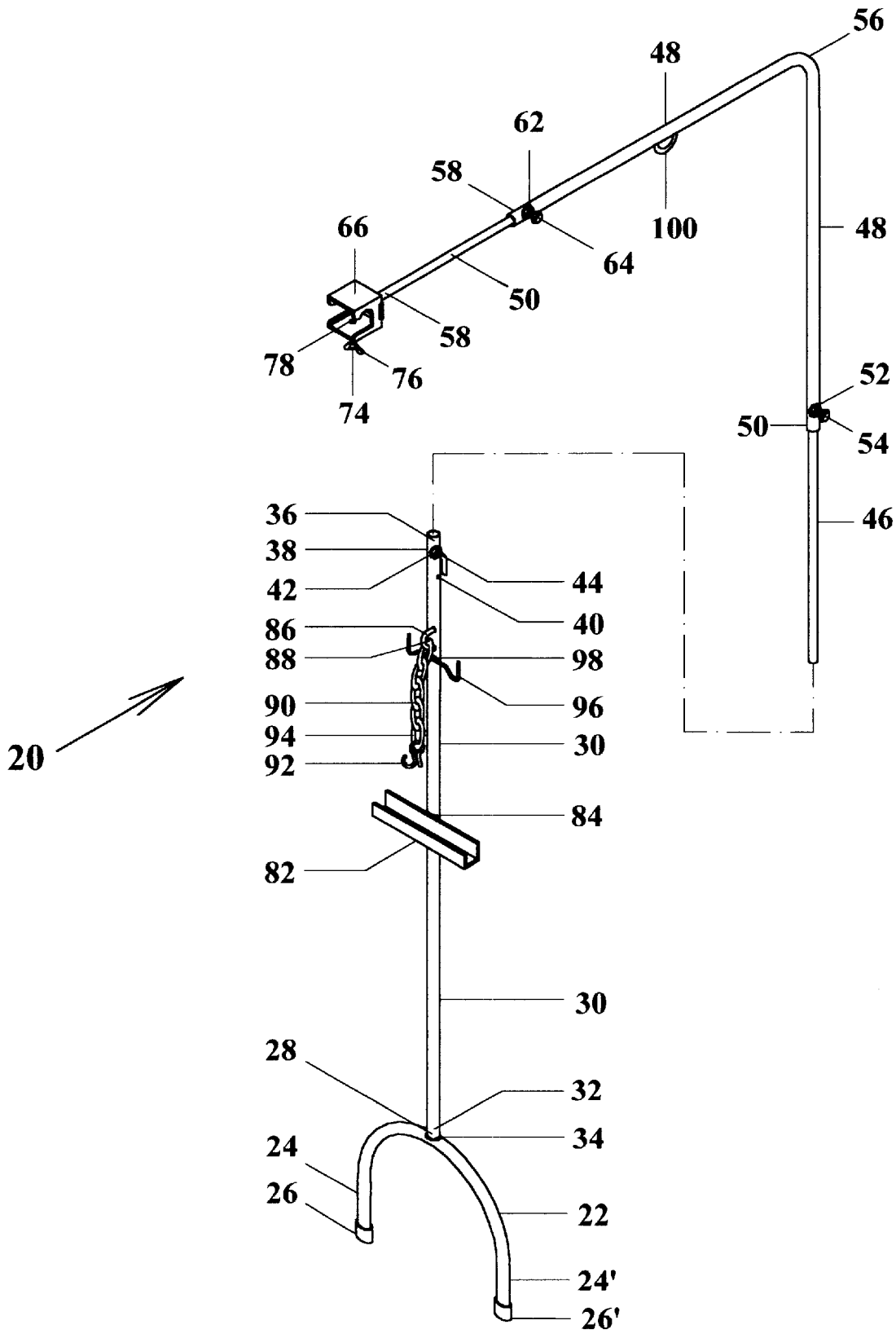
FIG. 6 is an isometric view of a disassembled stand with extended vertical and horizontal adjustment means.

Referring to FIG. 6, a solid vertical adjustment bar 46, the diameter of which is slightly less than the inside diameter of support 30, is coaxially inserted into socket 38. Bolt 44 is hand tightened, contacting bar 46 and forcing it against the sides of socket 38, thus securing bar 46 and support 30 as a single unitary entity for controlling unwanted longitudinal and lateral motion of bar 46 with respect to support 30. Bolt 44 can be loosened, allowing stand 20 to be separated into two sections for storage and transport.

Continuing with FIGS. 6, 3A, and 3B, bar 46 passes coaxially into the interior of the cylindrical, tubular, vertical portion of a lower end 50 of upper support 48 where it can be slidably adjusted vertically inside the tubing. Approximately 5 cm above the lower end 50 of support 48, a hole is drilled through one side, the diameter of which is slightly larger than the nominal size of a threaded, vertical, adjustment nut 52. Nut 52 is welded coaxially over the pre-drilled hole such that it will allow a vertical, adjustment bolt 54 to be threaded into nut 52 and to pass through the side and into the interior of support 48. Generally, when stand 20 is assembled for use, the longitudinal axis of bolt 54 is perpendicular to the longitudinal axis of support 48 and is coplanar with base 22. Bolt 54 is tightened contacting bar 46 and forcing it against the wall of support 48, thus securing bar 46 and support 48 as a single unitary entity for controlling unwanted longitudinal and lateral motion of bar 46 with respect to support 48. Tightening bolt 54 against bar 46 sets or locks the vertical adjustment to accommodate the height of a particular portable shelter. FIG. 3A shows a sectional view of the retracted vertical adjustment mechanism, and FIG. 3B shows a sectional view of the extended vertical adjustment means as incorporated in stand 20.

Figure 4A:
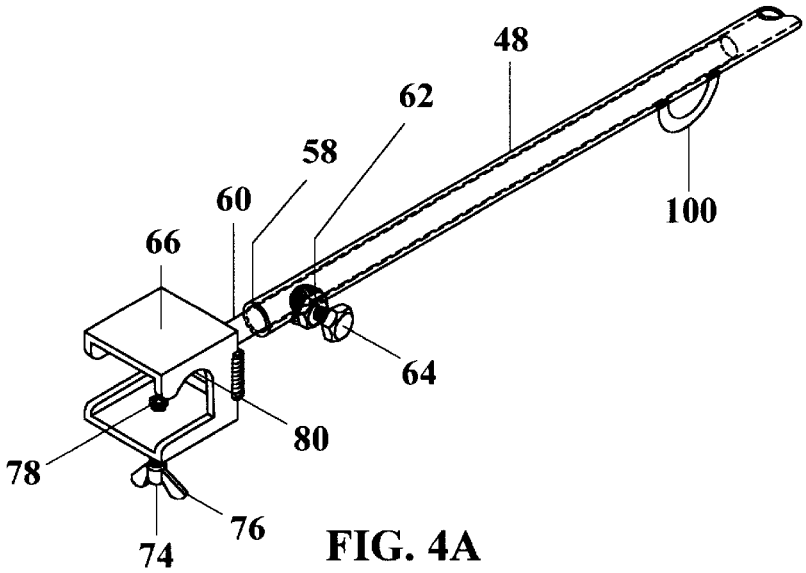
FIGS. 4A and 4B are isometric sectional views of the retracted and extended horizontal adjustment mechanism of a stand, respectively.
Figure 4B:
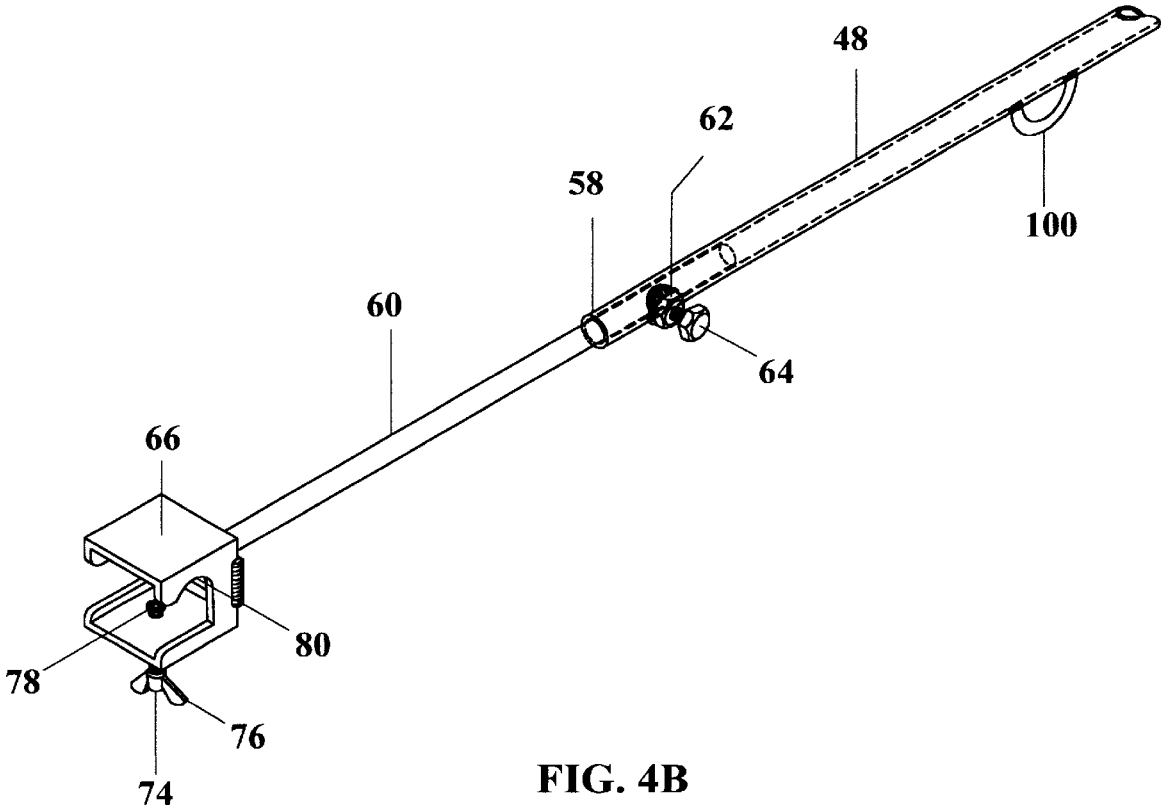

Referring to FIGS. 6, 4A, and 4B, support 48 continues vertically to a point where it forms a 90 degree bend 56 and, when stand 20 is assembled for use, extends horizontally, perpendicular to the plane of base 22. Referring to FIGS. 4A and 4B, a solid horizontal adjustment bar 60 passes coaxially into the interior of the cylindrical, tubular, horizontal portion of a distal end 58 of upper support 48 where it can be slidably adjusted horizontally inside of the tubing. Approximately 5 cm back from distal end 58 of horizontal support 48, a hole is drilled through one side, the diameter of which is slightly larger than the nominal size of a threaded horizontal adjustment nut 62. Nut 62 is welded coaxially over the pre-drilled hole such that it will allow a horizontal adjustment bolt 64 to be threaded into nut 62 and to pass through the side and into the interior of support 48. Generally, when stand 20 is assembled for use, the longitudinal axis of bolt 64 is horizontally oriented; perpendicular to the longitudinal axis of the horizontal portion of support 48. Bolt 64 is tightened contacting bar 60 forcing it against the side of support 48, thus securing bar 60 and support 48 as a single unitary entity for controlling unwanted longitudinal and lateral motion of bar 60 with respect to support 48. Tightening bolt 64 against bar 60 sets or locks the horizontal adjustment means to accommodate the width of a particular portable shelter. FIG. 4A shows a sectional view of the retracted horizontal adjustment mechanism, and FIG. 4B shows the sectional view of the extended horizontal adjustment mechanism of stand 20.

Figure 5A:
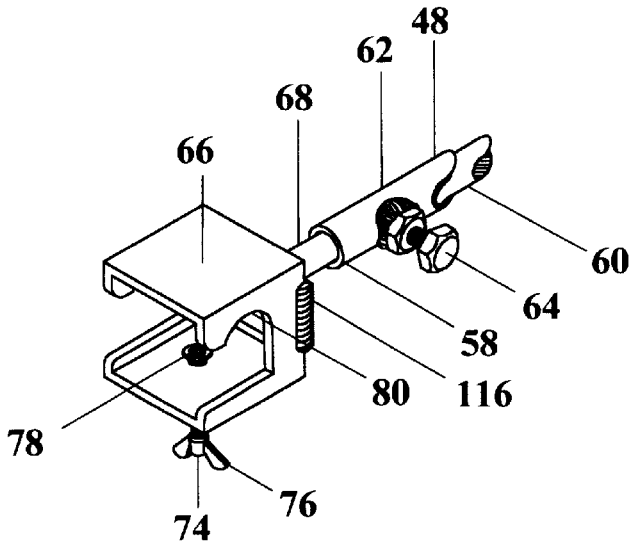
FIGS. 5A to 5C are isometric views of a beam clamp in various orientations.
Figure 5B:
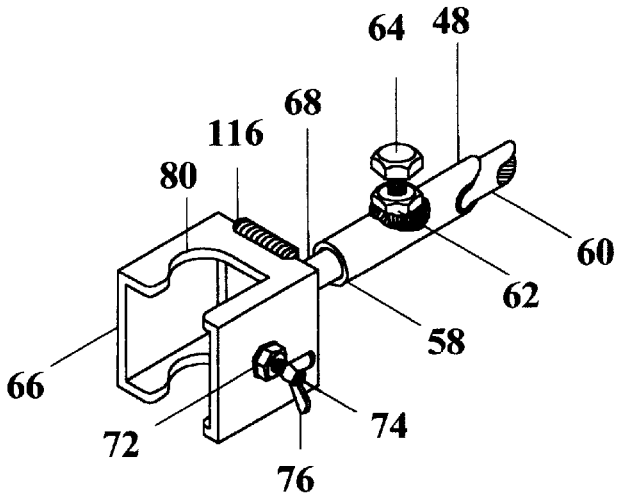
Figure 5C:
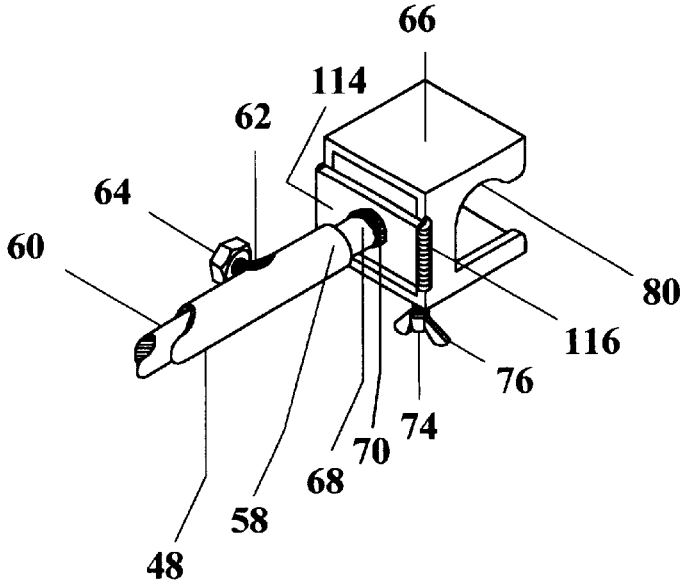

Referring to FIG. 5C, a beam clamp 66 is attached to a distal end 68 of bar 60. The body of the beam clamp 66 is made from square or rectangular, hollow, metallic tubing. Preferably, the width of beam clamp 66 is approximately 5 cm which provides secure attachment to the portable shelter's roof beam. The length or depth of the tubing must be large enough to accommodate the shape and size of a beam clamp cutout 80, which will be duplicated in one pair of opposing sides of the tubing. The shape and size of cutout 80 is determined by and duplicates the cross sectional shape and size of the longitudinal roof beam of a particular portable shelter. A front opening is provided in each cutout 80 to allow clamp 66 to encompass and engage the roof beam. Cutout 80 can be made using a vertical milling machine with an end mill tool, but regular home workshop tools can also be used, such as a drill and a file. Most of the material can be drilled out, and the rest can be removed by filing to produce the required profile. Because the beam clamp 66 body is hollow, a piece of flat stock 114 is welded to the rear end of each side of clamp 66 (sides which contain a cutout 80) by means of a flat stock weld 116. The center of stock 114 is attached to the circumference of the distal end 68 of bar 60 by means of a beam clamp weld 70. Referring to FIG. 5B, a centrally located hole is drilled through the bottom surface of clamp 66, the diameter of which is slightly larger than the nominal size of a beam clamp lock nut 72. Nut 72 is coaxially welded over the pre-drilled hole such that it will allow a beam clamp lock bolt 74 to be threaded into nut 72 and to pass through the bottom of clamp 66 into the central, interior portion of clamp 66 as shown in FIG. 5A. Lock bolt 74 is constructed by threading a beam clamp wing nut 76 onto bolt 74 as far as possible to the nonthreaded portion of bolt 74. The nonthreaded portion of bolt 74 is trimmed flush with the surface between the wings of wing nut 76. The trimmed flush surface of bolt 74 is then welded to wing nut 76 forming a unitary assembly. Wing nut 76 is used to facilitate hand tightening of bolt 74. The threaded portion of bolt 74 extending from wing nut 76 is threaded into beam clamp lock nut 72. Beam clamp pressure surface 78 consists of a flat washer welded to the threaded end of bolt 74 after it has been threaded through nut 72 into the interior of clamp 66. When bolt 74 is tightened by means of wing nut 76, surface 78 contacts the longitudinal roof beam of the portable shelter, forcing it up into the profile formed in cutout 80. Surface 78 provides a larger clamping contact area for increased beam gripping capability. Additionally, because surface 78 is welded to bolt 74, bolt 74 cannot vibrate out of nut 72 and become lost.

Figure 7A:
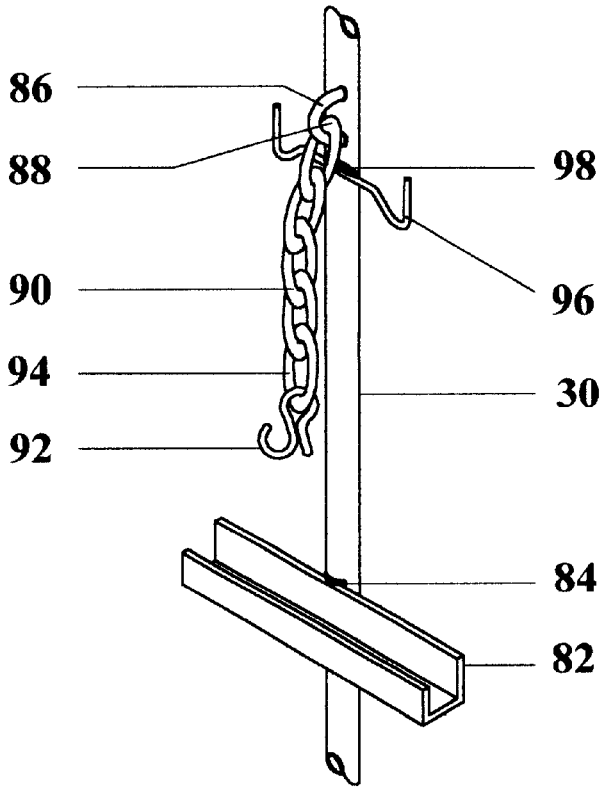
FIGS. 7A and 7B are isometric sectional views showing a heater bracket, heater safety chain, and a "sunflower"-type heater mounted in the heater bracket.
Figure 7B:
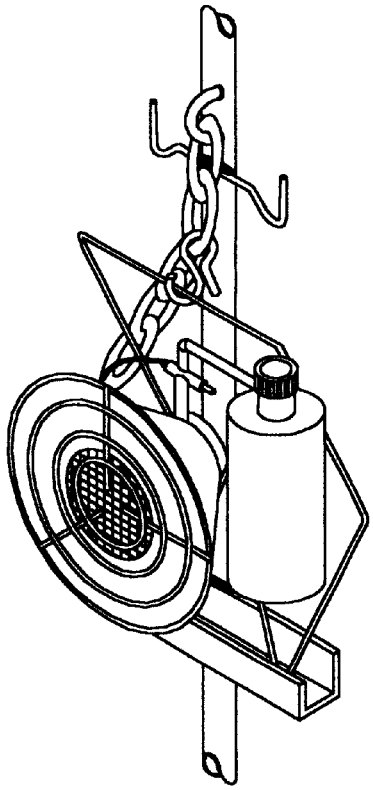

Referring to FIG. 7, a heater bracket 82, which is adaptable to a "sun flower"-type, metal rod framed heater, is attached in a horizontal orientation to support 30 with its longitudinal axis parallel to the plane of base 22. Heater bracket 82 is attached to support 30 by means of a heater bracket weld 84. An U-shaped chain attachment loop 86 passes through a link in an upper end 88 of a safety chain 90 and is welded to support 30 at a location below stop pin 40. Each end of loop 86 is aligned, one above the other, with the vertical axis of support 30, and perpendicular to the plane of base 22, and located on the same side of support 30, in relation to base 22, that bracket 82 is located. Each of the two ends of loop 86 is welded to support 30 attaching safety chain 90 to support 30. A safety hook 92 passes through a link at a lower end 94 of safety chain 90. Hook 92 attaches to the top horizontal rod of the heater frame to secure it safely in bracket 82 and to prevent it from falling to the floor should the heater base become dislodged from bracket 82. Additionally, hook 92 may be placed in various links of chain 90 to adjust the angle of the heater, within safe operating limits, relative to the floor, providing heat where it is most needed.

A double hook hanger bar 96 is attached to support 30 located below loop 86. Hanger bar 96 is horizontally oriented, parallel to the plane of base 22, and located on the same side of support 30, in relation to base 22, that bracket 82 is located. Hanger bar 96 is attached to support 30 by means of a hanger bar weld 98.

Referring to FIG. 2, a U-shaped lantern hanger loop 100 is welded to, and on the underside, of support 48 near the midpoint of its horizontal span. Each of the two ends of loop 100 is welded parallel to the longitudinal axis of the horizontal span of support 48. Loop 100 is used to suspend a lantern off the floor and to provide illumination from overhead.

FIG. 9 shows stand 20 in one embodiment of the invention while being used with a lantern and a "sun flower"-type heater as well as utilizing double hook hanger bar 96 to organize and store additional items, in this case, ice-fishing equipment. FIGS. 6 and 10 show stand 20 in an extended condition, having been adjusted for a particular portable shelter, and they show stand 20 in a disassembled condition. FIG. 10 also shows how the disassembled stand 20 lies inside a folded portable shelter (with the fabric covering partially cut away for clarity) for storage and transport.

ADDITIONAL EMBODIMENTS

Figure 11A:
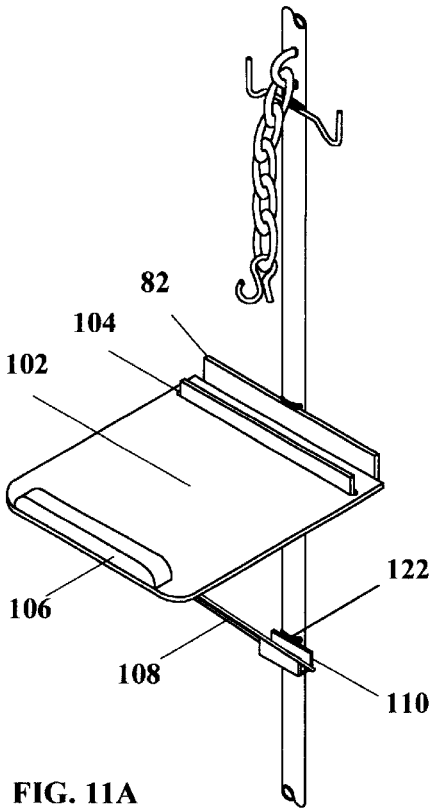
FIGS. 11A to 11D are isometric views a shelf type heater support according to an additional embodiment of the invention.
Figure 11B:
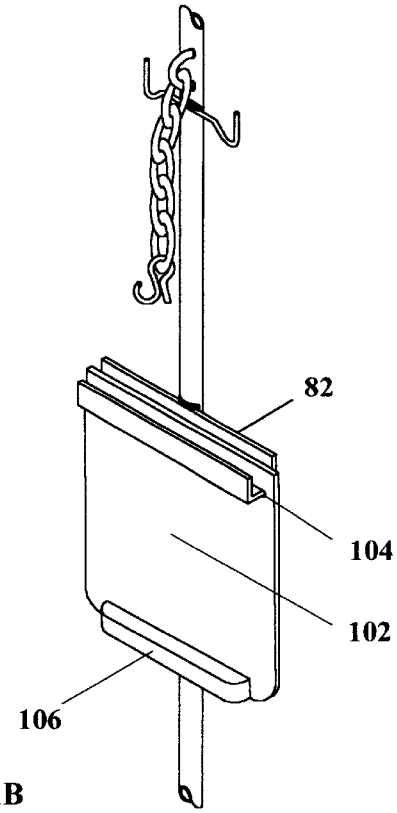
Figure 11C:
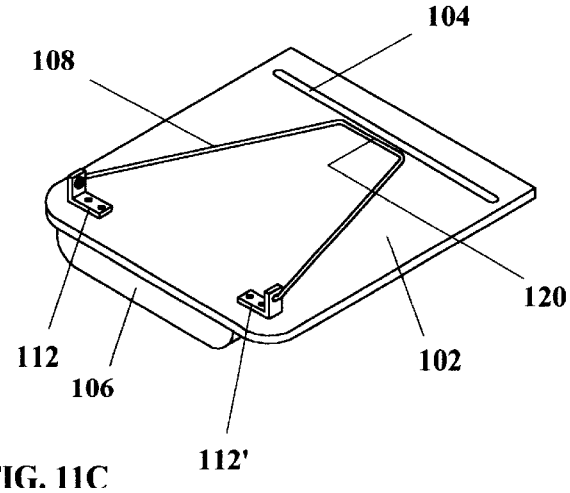

FIGS. 11A to 11D show an additional embodiment of the invention, in which a heater shelf 102 is attached to heater bracket 82. Shelf 102 is constructed from solid wood, plywood, metal, metal grill material, or any other flat sheet material meeting the safety requirements of the particular heater to be supported. Shelf 102 utilizes the existing heater bracket 82 as a form of hinge, equipping stand 20 to accommodate other various types of portable heaters. A shelf curb 106 is attached to the leading edge of the upper surface of shelf 102 by means of screws installed from the underside of shelf 102. Curb 106 prevents a heater or other supported object from sliding off the leading edge of shelf 102. The material for the shelf must be wider than heater bracket 82, the amount being based on the type and strength of the material being used. Referring to FIG. 11C, if the material being used is solid, a shelf slot 104 is cut, routed, or milled through the material in a location parallel to the rear edge of shelf 102. The width of slot 104 should be slightly greater than the width or thickness of the material used to make bracket 82. The length of slot 104 should be slightly longer than the overall horizontal length of bracket 82. The center point of the longitudinal axis of slot 104 should approximately coincide with a point on the longitudinal center line of shelf 102. The distance from the rear edge of slot 104 to the rear edge of shelf 102 should be slightly less than the inside width of the channel or trough in bracket 82. Operationally, when the longitudinal centerline of slot 104 is directly above and parallel to the top edge of the forward most vertical portion of bracket 82, the shelf can be lowered allowing the forward vertical portion of bracket 82 to pass through slot 104. The portion of shelf 102 rearward of slot 104 lies in the channel or trough of bracket 82, and, therefore, shelf 102 is supported by bracket 82. The width of slot 104 should be wide enough to allow shelf 104 to easily pivot downward and rest against support 30 as shown in FIG. 11 B. When in use to support a heater, shelf 102 is raised in a plane parallel to the portable shelter's floor and perpendicular to the plane of base 22. Shelf 102 is held in a horizontal position by means of a shelf support 108 as shown in FIG. 11A.

Figure 11D:
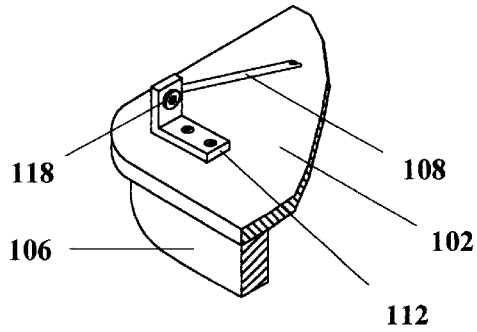

Referring to FIG. 11C, support 108 is formed by bending a metal rod into, basically, a flat bottomed V-shape with a horizontal section, instead of having the arms of the V-shape continuing on to an intersection. Each of the two ends of support 108 attach to the underside of shelf 102 by means of a support hinge 112 and 112' respectively. Hinges 112 and 112' are attached to the underside of shelf 102 near the front corners by screws or other suitable means depending on the material used to make shelf 102. Hinges 112 and 112' each have a hole through it which is slightly larger in diameter than the diameter of the rod used to make support 108. Each of the two ends of support 108 is bent into a L-shape, such that after bending, the circular flat ends are facing each other forming a planar support structure. Referring to FIG. 11D, the terminal end portion, extending past the bend in support 108, need only be long enough to pass through a hole in hinge 112 or 112', have a flat hinge washer 118 placed coaxially over the end of the rod, and have the washer welded to the end of the rod so that the rod can rotate in the hinge hole, and cannot be dislodged from the hole. Hinges 112 and 112' allow support 108 to pivot or fold in relation to shelf 102. When shelf 102 is in use, support 108 pivots downward towards base 22 and rests in a shelf support bracket 110, thus stabilizing shelf 102, as shown in FIG. 11A. Support bracket 110 can be made from a length of U-shaped channel stock of such a length and nominal size as to accommodate and securely hold a horizontal end portion 120 of support 108. Bracket 110 is welded to support 30 by means of a shelf bracket weld 122 at a location that will allow support 108 to hold shelf 102 in a horizontal position when stand 20 is in its normal operational orientation. Bracket 110 is located above and parallel to base 22 and on the same side of support 30, in relation to base 22, that bracket 82 is located. Referring to FIGS. 11B and 11C, when shelf 102 is lowered, a horizontal end portion 120 of support 108 is pivoted upwards from bracket 110 towards bracket 82 and is sandwiched between shelf 102 and support 30.

ADVANTAGES

From the description above, and due to the fact that there is nothing presently available, that I am aware of, to accomplish anything that my stand is able to accomplish, a number of advantages of my portable shelter stand becomes evident:

(a) My stand is light weight, of sturdy construction, and easily transportable. The stand does not require any additional space in a means of conveyance other than that which the portable shelter alone requires.

(b) My stand maximizes the usable floor area. The vertical planar structure of the base of the stand allows it to be placed immediately adjacent to a wall. If the arch shaped base of the stand was made from nominal 1.27 cm (½ inch) inside diameter tubular material, the base would require less than approximately 6.25 square cm (1 square inch) of floor space in the portable shelter.

(c) My stand is easily assembled for use by tightening a single bolt after the upper and lower sections have been aligned in a socket.

(d) My stand is easily disassembled by loosening a single bolt, then pulling the upper and lower sections apart for storage or transport.

(e) The stand supports a lantern providing the best visibility and safety for the occupants. The stand provides a lantern suspension loop, located in the middle of the horizontal support extension, which places a lantern closer to one wall than the other. In the case of ice fishing, it would suspend the lantern over the fishing holes where the illumination may attract fish, and it helps one to see down the fishing holes, which is very important when one has a fish on. Without the stand, the only other means to suspend the lantern is from the centrally located roof beam where it is close to the occupants' heads creating an obviously dangerous situation.

(f) The stand safely and securely supports a heater of the floor; it is equipped with a heater safety chain and hook that attaches to the heater frame so that it cannot fall from the bracket or shelf. The heater is located at a maximum horizontal distance from the occupants, allowed by the constraints of the walls.

(g) The stand is adjustable in width and height to fit in most portable shelters which utilize a horizontal, longitudinal, roof beam. From a manufacturing standpoint, only one model of stand would have to be manufactured to fit all presently made portable shelters utilizing a horizontal, longitudinal, roof beam. Based upon the demand for a stand that would fit in other types of portable shelters, the described stand could be easily altered to fit any portable shelter. From an individual standpoint, one purchasing a stand would know that the stand is adjustable to fit his or her portable shelter, and would fit any other similarly framed shelter purchased in the future.

(h) The stand provides a double storage hook to store additional items or articles off the floor of a portable shelter. To maximize usable floor space, to prevent damage to equipment, and for safety reasons, it is important to have some means to keep items off the floor. The double storage hook provides this means, especially for outdoor activity equipment items since many of them have straps, slings, or other means for suspending them.

(i) The stand provides additional portable shelter stabilization by supporting the roof fabric from vertical forces such as snow loads.

(j) The stand provides additional portable shelter stabilization by preventing the side wall (the side wall that it is adjacent to) from being blown inwards due to wind forces.

(k) The stand can be stored inside a collapsed, folded, portable shelter for storage, transportation, and be immediately available for reassembly.

(l) The stand is made from readily available materials at low cost. The materials can be found at most hardware stores or home building centers.

Operation

As to the manner of usage and operation of the present invention, a portable shelter is first erected at a location where the stand will be used. Referring to FIG. 6 and the lower portion of FIG. 3B, the upper and lower assemblies of stand 20 are assembled or joined by inserting the lower end of vertical adjustment bar 46, which extends from within upper support 48, into socket 38 which is located at the upper end of lower support 30. Upper support 48 is rotated or adjusted so that the horizontal portion of support 48 is perpendicular to the plane of base 22 and is on the same side of support 30, relative to base 22, that bracket 82 is located. Hand bolt 44 is tightened against bar 46 locking lower support 30 and upper support 48 together as a single unitary assembly. Referring to FIG. 1, stand 20 is then placed inside of the portable shelter and located such that the arched base 22 straddles the hinged floor seam of the shelter and is immediately adjacent to a side wall. If the portable shelter has been designed for ice fishing, the base 22 of the stand 20 should be placed on the side where the ice fishing hole cutouts are located.

Referring to FIGS. 1, 6, 3A, and 3B, the height of the stand 20 is then adjusted by loosening vertical adjustment bolt 54 and allowing upper support 48 to slide up or down on solid vertical adjustment bar 46 until the opening in beam clamp 66 is in horizontal alignment with the longitudinal roof beam of the portable shelter. Bolt 54 is then tightened, permanently setting or locking in the vertical adjustment for this particular portable shelter. This adjustment does not need to be altered to store the disassembled stand 20 inside of the collapsed, folded, portable shelter.

Referring to FIGS. 1, 6, 4A and 4B, the width of stand 20 is then adjusted by loosening horizontal adjustment bolt 64 and allowing solid horizontal adjustment bar 60 to slide in or out of the horizontal portion of upper support 48 until the beam clamp cutout 80 of beam clamp 66 is resting on the longitudinal roof beam of the portable shelter. At the point where the vertical support portion of the assembled stand 20 is generally perpendicular to the portable shelter's floor, bolt 64 is tightened, permanently setting or locking in the horizontal adjustment for this particular portable shelter. This adjustment does not need to be altered to store the disassembled stand 20 inside of the collapsed, folded, portable shelter.

Referring to FIGS. 1 and 5A, beam clamp lock bolt 74 is tightened against the longitudinal roof beam of the potable shelter securing it in the beam clamp cutout 80 of beam clamp 66. Stand 20 is now assembled, adjusted and ready for use.

Referring to FIGS. 6 and 10, stand 20 is prepared for transport by loosening beam clamp lock bolt 74 and disengaging the beam clamp cutout 80 of beam clamp 66 from the longitudinal roof beam of the portable shelter. Upper support 48 is disengaged from socket 38 in lower support 30 by loosening hand bolt 44 and removing the entire upper support assembly from socket 38. The upper and lower assemblies of stand 20 are stored and transported inside the collapsed, folded, portable shelter as shown in FIG. 10.

Referring to FIGS. 1, 2, and 9, as to the manner of usage of the present invention, a lantern is suspended from hanger loop 100 located on the underside of the horizontal portion of support 48. Because a liquid or propane fueled lantern produces considerable heat, and because heat rises, the lantern should be suspended at a safe distance from the roof of the portable shelter so that the heat doesn't damage the fabric outer shell.

A "sunflower"-type heater can be mounted directly in bracket 82 with safety chain 90 being attached to the heater frame by means of safety hook 92. Safety chain 90 and hook 92 will prevent a heater from falling to the floor preventing a potentially dangerous situation.

Referring to FIGS. 2 and 9, a double hook hanger bar 96 can be used to support additional pieces of equipment. This multi-use hanger is especially useful to support equipment items which have suspension straps or cords attached to them.

Referring to FIG. 11A, according to another embodiment of my stand, a shelf 102 can be attached to bracket 82 to support other types of heaters or, for additional equipment storage above the floor.

Conclusion, Ramifications, and Scope

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention in as much as the present disclosure includes that contained in the appended claims as well as the forgoing description. Although this invention has been described in its preferred forms with a certain degree of particularity, it is understood that the present disclosure of the preferred form has been made by way of example and numerous changes in the details of construction and combination and arrangement of parts may be resorted to without departing from the spirit and scope of the invention.

I claim:

1. A portable stand for supporting a lantern in a portable shelter, comprising:

(a) a generally vertical, arch-shaped, planar base, (b) a vertical support connected to said base and extending generally upwardly from said base, (c) said vertical support extending to substantially a right-angled bend in said vertical support, (d) a horizontal support extending from said right-angled bend, (e) a lantern hanger bracket attached near the midpoint of said horizontal support, (f) an open-cavity beam clamp, for clamping onto a portable shelter's framework, attached to the distal end of said horizontal support, whereby said portable stand safely and securely supports a lantern above the floor in a portable shelter.

2. The stand of claim 1 further including a socket and hand bolt disassembly means located near the midpoint of said vertical support.

3. The stand of claim 2 further including an adjustment bolt and adjustment bar first means for vertical adjustment located in said vertical support.

4. The stand of claim 3 further including an adjustment bolt and adjustment bar second means for horizontal adjustment located in said horizontal support.

5. The stand of claim 1 wherein a channel bracket heater support is attached to said vertical support.

6. The stand of claim 5 wherein a heater safety chain, equipped with an article hook, is attached to said vertical support.

7. The stand of claim 6 further including a socket and hand bolt disassembly means located near the midpoint of said vertical support.

8. The stand of claim 7 further including an adjustment bolt and adjustment bar first means for vertical adjustment located in said vertical support.

9. The stand of claim 8 further including an adjustment bolt and adjustment bar second means for horizontal adjustment located in said horizontal support.

10. The stand of claim 6 wherein a horizontal, double-hook hanger bar is attached near the midpoint of said vertical support.

11. The stand of claim 10 further including a socket and hand bolt disassembly means located near the midpoint of said vertical support.

12. The stand of claim 11 further including an adjustment bolt and adjustment bar first means for vertical adjustment located in said vertical support.

13. The stand of claim 12 further including an adjustment bolt and adjustment bar second means for horizontal adjustment located in said horizontal support.

* * * * *